United States Patent [19]

Kozak et al.

[11] Patent Number: 4,983,068

[45] Date of Patent: Jan. 8, 1991

[54] CONSTRUCTION MATERIAL

[76] Inventors: William G. Kozak, 1085 Oakleigh Rd., N.W., Grand Rapids, Mich. 49504; Felicia E. Frizzell, 1048 Griswold, SE., Grand Rapids, Mich. 49507

[21] Appl. No.: 337,928

[22] Filed: Apr. 14, 1989

[51] Int. Cl.[5] ..... E02B 11/00

[52] U.S. Cl. ..... 405/36; 52/169.5; 405/45; 405/50; 428/35.2

[58] Field of Search ..... 428/35.2, 36.1, 68; 52/DIG. 9, 169.5; 405/36, 43, 44, 45, 46, 47, 48, 50

[56] References Cited

U.S. PATENT DOCUMENTS

| | | | |
|---|---|---|---|
| 3,576,649 | 4/1971 | Brazier | 428/35.2 X |
| 3,836,416 | 9/1974 | Ropiequet | 156/167 X |
| 3,878,147 | 4/1975 | Craven | 428/521 X |
| 3,993,812 | 11/1976 | Debbas et al. | 428/35.2 |
| 4,225,443 | 9/1980 | Harris et al. | 428/406 X |
| 4,235,365 | 11/1980 | Yoshii et al. | 428/35.2 X |
| 4,451,175 | 5/1984 | Yamashita et al. | 405/50 |
| 4,639,165 | 1/1986 | Flecknoe-Brown | 405/50 X |
| 4,655,637 | 4/1987 | Vignocchi | 405/258 X |
| 4,664,957 | 5/1987 | vande Pol | 428/36.1 X |
| 4,793,728 | 12/1988 | Ellis | 405/50 X |

*Primary Examiner*—Henry F. Epstein

*Attorney, Agent, or Firm*—Price, Heneveld, Cooper, DeWitt & Litton

[57] ABSTRACT

A construction bag suitable for use in soil erosion application and for draining roadbeds and construction footings. The bag has a tube-like outer shell made of Geotextile construction fabric and is filled with crushed scrap glass. The construction fabric should be of adequate thickness so as not to be easily punctured by the glass. The scrap glass is random pieces from up to about 2½ inches in size and with the majority of the pieces being less than 1½ inches in size. The method of making and of using the construction bag are also disclosed.

4 Claims, 2 Drawing Sheets

CONSTRUCTION MATERIAL

BACKGROUND OF THE INVENTION

The American glass industry produces over 17 million tons of glass products each year. Of that, over 11 million tons are glass containers, bottles and jars. The State of Michigan, as a representative state, generates over 645 thousand tons of glass container waste each year. The state does have a deposit law so it is estimated that approximately one-half of this amount is recovered. Of the remaining half, a few cities, towns and counties have recycling programs but these in total only amount to approximately 1 percent of the glass recovered. It is estimated that there is approximately 60 thousand tons of glass scrap available for recovery. This scrap glass is a valuable resource.

While many people recognize that scrap glass is recoverable, the cost of recovering the glass is, in most cases prohibitive. By the time the glass is cleaned to remove food and labels, sorted by color, crushed and then transported to a glass plant for reuse, the cost of a ton of scrap glass approaches or exceeds the cost of a ton of new glass. In view of the very slim margin for profit, most cities and towns have neglected recovering scrap glass as an economic and environmental project.

In accordance with the teachings of the present invention, construction materials have been developed which use recycled glass which does not require color separation, cleaning, long haul and expensive transportation or rigid sizing specifications.

In building roads and highways and in constructing homes and buildings, an important consideration is the proper drainage of the soil. In building a road, for example, ditches are dug along the edge of the road bed. The ditches are then partially filled with crushed stone followed by a porous plastic pipe covered with a cloth sleeve or sock and then completely filled with sand and gravel. In this construction, the water can percolate down through the sand and gravel into the porous pipe where it can be carried off. Around building foundations, it is also necessary to install similar drain fields to carry water away from the footings so that the building can sit on stable ground, minimizing the possibility of settling and water leaking through the foundation wall. All of these drain construction projects require the use of expensive materials, such as hollow pipe and carefully sized aggregate.

In the construction of highways, it often occurs that the sides of an embankment, for example near a road drainage ditch, have to be supported and protected from sliding down into the ditch. It is particularly important to not only support but to adequately drain the embankment to protect the support material from being washed away. All of these problems are compounded in the northern climates where the drainage system is subject to freezing, expansion and contraction and ground heaving. Also within the cross section of a road or highway, it is common practice to promote drainage in the subgrade zone to minimize frost heave and control the water table rise due to capillary pressures associated with temperature differentials and variable soil compositions, thus extending pavement life.

SUMMARY OF THE INVENTION

In accordance with the present invention, all of the roadway and building site drains and the reinforced embankments can be made using fabric containers filled with crushed glass scrap. The method of preparing the containers and of using them in various drain and construction examples are also presented.

DETAILED DESCRIPTION OF THE PREFERRED EMBODIMENTS

Figure 1:
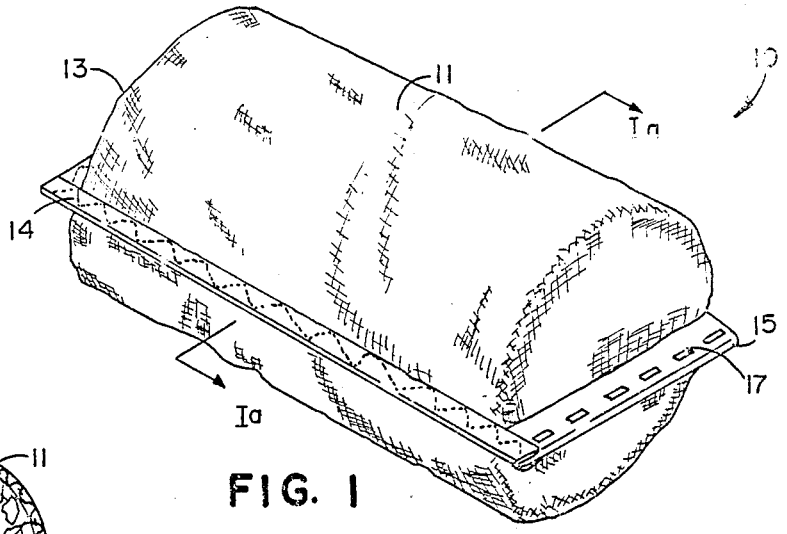
FIG. 1 is side perspective view of a construction bag of the present invention.
Figure 1A:
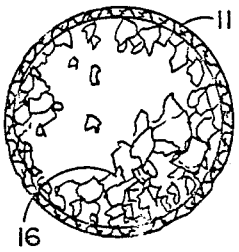
FIG. 1*a* is a sectional view along the line Ia—Ia of FIG. 1 to show the crushed scrap glass in the bag.

Referring to FIG. 1, a sealed bag indicated generally by the number 10 is shown which has an elongated body portion 11, an end 13 and a rolled end 15. The end 13 and side 14 can be closed by stitching or with staples, these being the preferred methods. Obviously, many other suitable closure techniques can be used. After filling with a random assortment of glass pieces 16, FIG. 1*a*, the open end of the bag is closed and then rolled or folded tightly back toward the body of the bag and then sealed with industrial staples 17. The preferred staples used are referred to as Industrial ⅜ Staples which have a center portion and two depending end portions each approximately ⅜ inch in length. Other size staples as well as other methods of sealing can be used as known to those skilled in the art, for example, heat sealing or sewing.

The constructions bags are prepared from a woven or non-woven Geotextile fabric material made of strong polymeric fibers which resist cutting. There are several suppliers of Geotextile fabrics, for example, Phillips Fibers Corporation, Amoco Fabrics Company, E. I. du Pont de Nemours & Co, and Polyfelt, Inc. A preferred material is a non-woven spun bonded, polypropylene fabric which is sold by du Pont under the trademark TYPAR®. Another preferred material is TREVIRA TM Spunbond available from Hoechst Fibers Industries that is a polyester needle-punched nonwoven fabric. Many synthetic materials are suitable for use in manufacturing the bags, polyethylene, polypropylene, polyester, woven and non-woven are examples of materials. It is important that the material selected be permeable to water with a tendency to wick water from the surrounding soil into the formed bag. It is also important that the woven material selected be permeable to water, with a tendency to pass water-borne suspended solids through the inside of the formed bag in a soil erosion application. Geotextiles are a well-known class of materials available from several manufacturers with a long projected useful life. The materials can be specified to be stable to ultraviolet light and will not rot when buried underground in moist conditions for extended periods of time.

Since the finished bags are to be filled with crushed glass, it is important that the fabric be strong enough to resist easy puncturing by sharp points and edges of the glass. While some glass shapes can perforate the fabric, the fabric should be selected so that essentially only these pieces can perforate and the majority will not. While many different thicknesses can be used, a fabric weighing approximately 4.5 ounces per square yard has been found acceptable. Tests have also been carried out with a 6 ounce per square yard fabric and these also were successful.

The construction bags can be of any convenient size and shape. The preferred configuration is a substantially tubular shape 4 to 10 inches in diameter and approximately 40 to 50 inches in length. The most preferred configuration is a bag approximately 6 inches in diameter and 40 inches in length. A bag of this size weighs approximately 40 to 50 pounds when filled with crushed scrap glass and is a convenient size and weight for hand manipulation. While larger bags can be made as the weight increases, the need also arises for the use of special equipment to handle the bags, for example, forklifts or front-end loaders.

Figure 2:
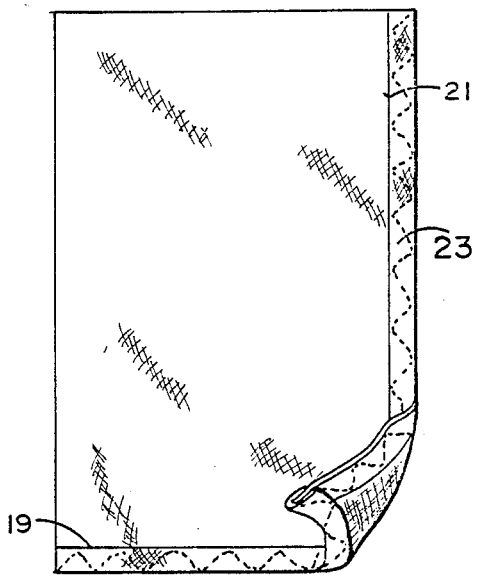
FIG. 2 is an elevational view of an empty bag showing the selvage after sealing.

The bags can be formed on a continuous basis by folding over a length of the Geotextile material on top of itself as shown in FIG. 2 and then stitching the bottom 19 and side 21 with a synthetic thread such as nylon, polypropylene or polyethylene thread. In the preferred method of making the bag, the material is folded over along the length approximately one-half inch short. The excess material is then folded back over the edge. The tube is then sealed. The bottom of the bag is closed by rolling several turns of the tube toward the bag followed by sealing through the several layers. The selvage 23 around the bag can also be stapled or heat sealed or ultrasonically bonded to form the bag. At the end of the side joining process, the material can be cut off leaving the next length of Geotextile material to form the next bag and the bottom of the first bag ready for closing.

Figure 3:
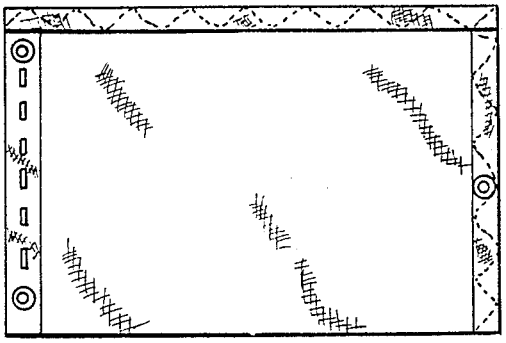
FIG. 3 shows a closed and stapled bag with grommet holes at each end.
Figure 4:
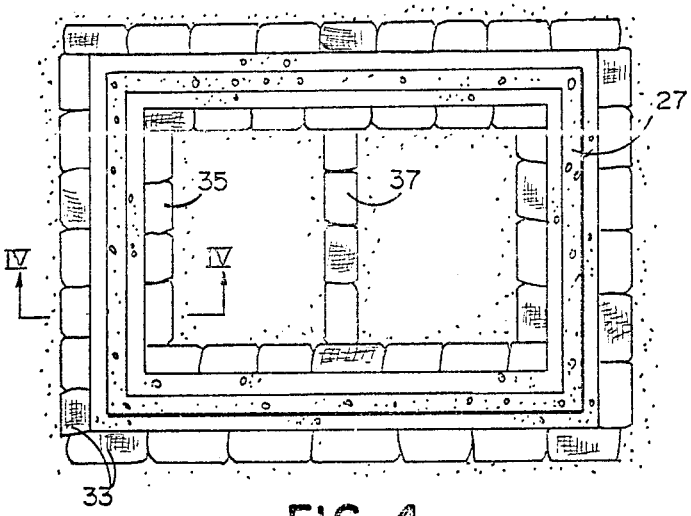
FIG. 4 is a schematic representation of a foundation for a building showing a drainage system installed using the bags of the present invention.
Figure 8:
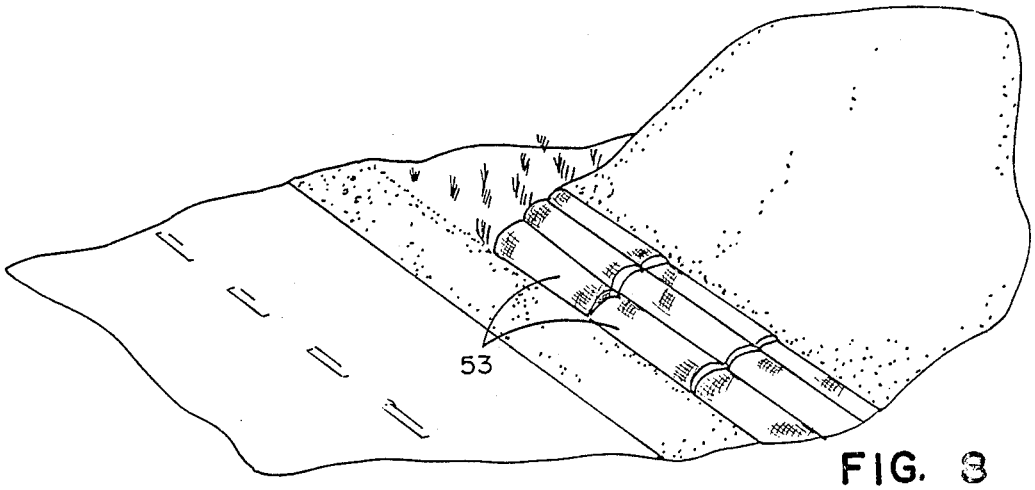
FIG. 8 is a perspective view of an embankment supported by a plurality of bags of the present invention.

When the construction bags are to be used in soil erosion control applications, it is convenient that a means be provided to hold the bags in place. Referring to FIG. 3, grommet holes are shown at each end of the bag. A grommet hole can be stitched into the bag using a nylon or polypropylene fiber or can be a metal or plastic grommet. Many techniques are available for adding grommet holes. When the bags are then used in a soil erosion control application, as shown in FIG. 8, the bags can be pinned down with suitable pegs of plastic metal or wooden material to hold them from moving or sliding down the embankment.

The glass used to fill the construction bags is scrap glass of any combination of colors which has been freed from food residue and crushed so that the majority of pieces are less than 1½ inches in size with larger pieces up to about 2½ inches in size. After crushing, the glass is screened with the preferred glass size being approximately 1½ inch and smaller with not more than 2 percent by weight passing through a #100 sieve (U. S. Standard Series). The scrap glass can be made from bottles, jars, non-returnable glass containers and any other kind of glass that finds its way to the local collection depot or dump. The construction bags of the present invention enable small communities to find a valuable use for the scrap glass raw material which is cluttering up landfills and damaging incinerators. The glass is only rough crushed so that the glass particles are rather large and allow water to flow readily. The type of equipment used to crush and sieve the glass is conventional and within the ordinary skill in the art and is not, therefore, described in detail.

As mentioned above, the preferred shape for the bag is a tube with the preferred size being approximately 6 inches in diameter and 40 inches long. This bag weighs approximately 15 pounds per lineal foot. Another preferred size is a 4-inch diameter tube which weighs approximately 6 ½ pounds per lineal foot. While these are preferred sizes, it is clearly within the scope of the present invention to make the tubes of greater diameter, longer or of different shape than a tube in order to meet a particular engineering requirement.

Figure 5:
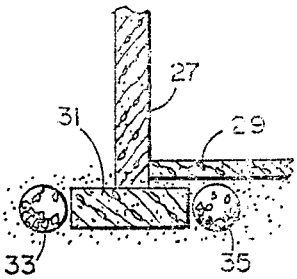
FIG. 5 is a partial sectional view taken along the line IV—IV of FIG. 4.

FIG. 5 presents a schematic view of a building foundation having a wall 27, a floor 29 and a footing 31. On either side of the footing 31, glass filled construction bags 33 and 35 are placed end-to-end completely around the inside and outside of the foundation. In particularly moist areas, a pattern of end-to-end bags 37 can also be formed underneath a basement floor. With all of the bags joined end-to-end and the pattern 37 tied in to the runs around the edge of the foundation, the water will tend to drain away from the foundation of the building by gravity flow to a drain outlet or sump pump (not shown).

A series of tests were carried out to determine the effectiveness and technical properties of the crushed glass drain system. Tests were conducted on both the 6-inch and 4-inch diameter units filled with crushed glass. The 4-inch diameter units weighed 22.3 pounds (6.7 pounds/foot) and the 6-inch diameter units weighed 45 pounds (13.5 pounds/foot). In order to evaluate the effectiveness of the crushed glass drains, a prototype trench was fabricated and flow measurements through the trench were obtained. The prototype trench was essentially a 2-foot wide, 10-foot long and 3-foot high unit with wooden sides and bottom. It was lined with plastic and filled with 2 feet of compacted sand. The glass drain units were placed on 6 inches of sand near the bottom of the trench then the remainder of the sand was filled in. Two stand pipes were then installed in the trench. The trench was filled with tap water until the sand was saturated and the static water level was 2 inches above the top of the sand. Stabilized flow measurements were obtained through a 6-inch diameter outlet in the trench through which one of the drain units was partially protruding. A comparison test was made between a drain made of end-to-end 6-inch bags, end-to-end 4-inch bags, a continuous 6-inch bag without interior seams as you would have in butting closed bags together, sand only and a 6-inch in diameter perforated plastic pipe wrapped with non-woven Geotextile material. The following table shows the results of this comparison test.

| TEST | STABILIZED FLOW RATE, GPM |
|---|---|
| 6 inch diameter, end to end | 1.5 |
| 6 inch diameter continuous | 1.5 |
| 4 inch diameter, end to end | 1.2 |
| sand only | 0.2 |
| 6 inch slotted pipe wrapped in Geotextile | 1.7 |

-continued

| TEST | STABILIZED FLOW RATE, GPM |
|---|---|
| fabric | |

The relative flow evaluation testing performed on the glass drain system indicates the unit significantly increased the rate of water flow through the typical sand-filled trench by a factor of over 7 for the 6-inch diameter units and a factor of over 6 for the 4-inch units. The flow rates through the 6-inch diameter crushed glass drain was nearly 90 percent of the measured flow through a conventional perforated plastic underdrain wrapped in filter fabric. The 6-inch diameter unit of continuous length flowed the same as the standard 6-inch diameter units with end seams butted every 40 inches.

A series of compression tests were also carried out to determine the deformation of the glass drain system relative to the conventional 6-inch perforated plastic pipe wrapped in filter fabric. In the test, a vertical load was placed on each of the drains and the relative deflection was determined. As a result of the test, it was found that the two drain systems had substantially the same weight/distortion graph with the crushed glass drain requiring approximately 200 pounds more pressure to exhibit the same deflection as the plastic drain. It is clearly a strong construction material.

Figure 6:
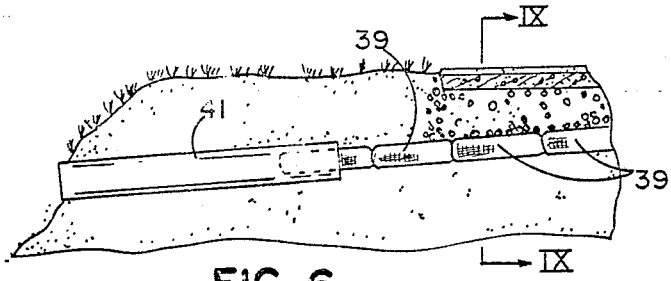
FIG. 6 is a cut-away view showing a drain installed in the side of a hill.

The crushed glass drain system can be used in many different construction applications. FIG. 6 shows the glass filled construction bags 39 end-to-end in a drain for a road subgrade. The end of the one of the plastic bags is telescoped within the end of a plastic pipe 41 with the other end of the pipe being cut off to match the slope of the bank.

As discussed above in relation to the tests, the end-to-end construction bags will freely pass water which drains through the road subgrade down and out the pipe 41. In view of the solid nature of the construction bags, there is no danger of any soft spots developing in the road subgrade where a perforated plastic pipe might crush under load.

Figure 7:
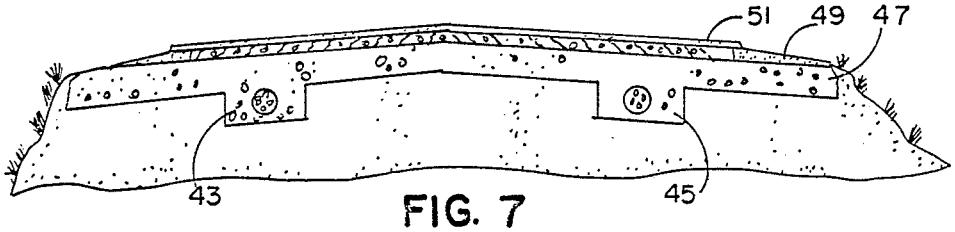
FIG. 7 is a sectional view of a road showing the drain system installed on either side of the road bed.

In FIG. 7, a section of the highway is shown having two spaced trenches 43 and 45 which are first filled with approximately 6 inches of compacted sand. The construction bags filled with crushed glass are then laid on top of the compacted sand in the trench and placed end to end along the highway and then the remainder of the compacted sand subbase highway bed 47 is put in place. This provide a continuous drain below the highway for the water to percolate through the compacted sand subbase down into the glass-filled bags and then off to a suitable drain where the water can be carried away, (FIG. 6). After the compacted sand subbase is placed, a layer of road gravel 49 is placed and capped with bituminous pavement, or a concrete pavement is placed over the sand subbase 51.

Each of the bags shown in FIG. 8 is made of a woven Geotextile material and is similar to the bag of FIG. 3 having a grommet holes so that a suitable stake or peg 53 can hold the bag in place. With this configuration, the embankment will be stabilized and protected from drainage water which might come down the embankment. In soil erosion control applications, a woven material is preferred. The high permeability of the bags will allow the water to pass through the bags without having the dirt washed away.

It can be seen then according to the present invention that a readily available waste material, crushed glass, is employed in a novel way to provide a construction bag suitable for use as both a drain and a soil erosion control device. The examples shown are merely representative of areas where the construction bag can be used and is not meant to be a limitation on the potential applications of the bag.

Though the invention has been described with respect to specific preferred embodiments thereof, many variations and modifications will immediately become apparent to those skilled in the art. It is, therefore, the intention that the appended claims be interpreted as broadly as possible in view of the prior art to include all such variations and modifications.

The embodiments of the invention in which an exclusive property or privilege is claimed are defined as follows:

1. A device for use in draining and retaining soil comprising:

a water permeable container, said container being made of a construction fabric material of adequate thickness to not be easily punctured by crushed scrap glass; and a crushed scrap glass filling material for said container.

2. A device for use in draining water from under roadways and around building foundations comprising:

at least one closed end substantially tubular water permeable outer shell made of construction fabric of adequate thickness to not be easily punctured by crushed scrap glass; and a crushed scrap glass filling for said shell.

3. A drain for a construction site comprising a plurality of tubular bags of water permeable construction fabric filled with crushed scrap glass in contact in the area to be drained so that the water will drain by gravity through the bags.

4. A device for use in draining water as set forth in claim 3 wherein said water permeable bags are made of construction fabric of adequate thickness to not be easily punctured by the glass.

* * * * *